United States Patent [19]

Butler

[11] Patent Number: 5,035,082

[45] Date of Patent: Jul. 30, 1991

[54] GATE SUPPORT AND OPERATING MECHANISM

[75] Inventor: Colin Butler, Putney, Vt.

[73] Assignee: Embassy Gates Associates, L.P., Pottsville, Pa.

[21] Appl. No.: 245,841

[22] Filed: Sep. 16, 1988

Related U.S. Application Data

[63] Continuation-in-part of Ser. No. 240,537, Aug. 29, 1988, Pat. No. 4,916,859, which is a continuation-in-part of Ser. No. 157,828, Feb. 19, 1988, abandoned, which is a continuation of Ser. No. 70,272, Jul. 6, 1987, abandoned, which is a continuation of Ser. No. 751,092, Jul. 12, 1985, abandoned.

[51] Int. Cl.[5] ..... E05F 15/02

[52] U.S. Cl. ..... 49/334; 49/381

[58] Field of Search ..... 49/340, 334, 28, 333, 49/338, 381, 396; 16/275, 276; 248/161

[56] References Cited

U.S. PATENT DOCUMENTS

| | | | |
|---|---|---|---|
| 1,192,592 | 7/1916 | Winter . | |
| 1,540,490 | 2/1924 | Mertel . | |
| 2,311,967 | 2/1943 | Sawyer | 49/334 |
| 2,592,891 | 11/1949 | Hall . | |
| 4,665,650 | 5/1987 | Hall . | |
| 4,818,137 | 4/1989 | Gorlov . | |

FOREIGN PATENT DOCUMENTS

| | | | |
|---|---|---|---|
| 3021114.4 | 12/1981 | Fed. Rep. of Germany . | |
| 2485075 | 12/1981 | France | 49/28 |
| 0583696 | 10/1958 | Italy | 49/334 |

OTHER PUBLICATIONS

One sheet of drawing entitled, "Vamvakius".

*Primary Examiner*—Kenneth J. Dorner
*Assistant Examiner*—Gerald A. Anderson
*Attorney, Agent, or Firm*—Dann, Dorfman, Herrell and Skillman, P.C.

[57] ABSTRACT

An assembly of apparatus for supporting an automatically or manually operating gate which includes a fixed gate-post with a power line and co-acting actuator for moving the gate, disposed within a gate-column or, alternatively, concealed within a housing attached to the hinge on the inside of the gate itself. An embodiment swings vertically. An electronic controller and sensors may be utilized.

12 Claims, 9 Drawing Sheets

GATE SUPPORT AND OPERATING MECHANISM

This is a continuation-in-part of a Ser. No. 07/240,537, filed Aug. 29, 1988, now U.S. Pat. No. 4,916,859 U.S. patent application Ser. No. 07/157,828, for a GATE SUPPORT AND OPERATING MECHANISM, filed Feb. 19, 1988, now abandoned. The U.S. patent application Ser. No. 07/157,828 is a continuation of U.S. patent application Ser. No. 7/070,272, filed July 6, 1987, now abandoned; which is a continuation of U.S. patent application Ser. No. 06/751,092, filed July 2, 1985, now abandoned. The above applications are all hereby incorporated by reference into this applications. The benefit of those earlier filing dates is hereby claimed on any subject matter these applications may have in common.

FIELD OF INVENTION

The present invention relates to operating and support mechanisms for entrance and exit gate systems.

More specifically, the invention concerns operating means mounted inside a gate-post for opening or closing the gate automatically or manually, and means for supporting the gate when the gate is in motion; that is, being opened or closed; or when the gate is at rest, either in the open or closed position.

Alternatively, the invention contemplates operating means mounted exteriorly of the gate-post, such as on the gate hinge, for closing and opening the gate to which the hinge so modified is attached.

Alternatively, the invention contemplates an embodiment which swings the gate in a vertical plane instead of a horizontal plane.

DESCRIPTION OF THE PRIOR ART

It is known to automatically or manually operate closures in the form of doors or gates of various kinds such as canopy-type doors, sliding doors and gates which open in and out or swing from a hinged pivot point. It is also known to embody operating means mounted on the closure itself as seen in U.S. Pat. No. 3,775,906 which discloses a sliding gate or portal and an operating device 10 mounted thereon. It is also mentioned that U.S. Pat. No. 1,631,416 is concerned with a gate opening in a turning movement which is operated by a drive supported on the gate itself. Other patents which show gate mounted operating means include U.S. Pat. Nos. 597,285; 445,052; and 181,985.

Such prior art references, however, do not appear to disclose or suggest an operating mechanism concealed from view inside a gate-column, or an independently placed port member from which lateral gate mounting hinge members are extended in combination with a gate operating element mounted on the gate at the end of the gate mounting members as, for example, on a hinge attached to the gate.

SUMMARY OF THE INVENTION

The gate support and operating mechanism of the invention comprises means mounted inside a gate-post or alternatively on a hinge attached to the gate itself for automatically opening or closing the gate, partially or completely. The invention also comprises means for supporting or anchoring the gate-post in a fixed position against relative movement in any direction, except as noted below; notwithstanding the positioning of the gate operating mechanism inside the gate-post or on the gate hinge.

If the circumstances of a particular installation should so require, the relative position of the post may be adjusted by bodily elevating it slightly and/or tilting it minimally, for ease of installation and alignment and to facilitate satisfactory operation of the gate closure.

The operating mechanism of the invention comprises a hydraulic flow, reversible power unit or line which is constructed and arranged to coact with a flange mounted rotary actuator. The actuator is responsive to the hydraulic action of the power unit to provide means for opening or closing the gate, as desired, or as circumstances may require.

. The coacting power line and rotary actuator may be mounted out of sight within the gate-post or, alternatively, may be securely fastened to the innerside of the gate hinge adjacent the gate-post.

In the vertically swinging embodiment, the hydraulic actuator is mounted with its axis of rotation oriented horizontally and substantially perpendicular to the plane formed by the opening which is to be barred by the gate. The actuator is mounted in a cylindrical housing, the axis of the cylinder being coincident with the axis of rotation of the actuator. A plurality of legs are welded to the horizontal housing and are mounted upon threaded rods which are embedded in a concrete footing. Mounting nuts ar screwed onto the threaded rods and adjusted to position the legs in order to achieve the desired height and orientation of the gate. The legs are then rested on the mounting nuts and secured to the rods by means of securement nuts.

Advantages of the vertical embodiment are that it requires less ground surface area than a gate which swings in a horizontal plane, and that it is less likely when swinging open to interfere with a vehicle or person within the arc described by its swing.

BRIEF DESCRIPTION OF THE DRAWINGS

With the above and other objects in view, as will be apparent, the invention consists in the construction, combination and arrangement of parts, all as hereinafter more fully described, claimed and illustrated in the accompanying drawings, wherein:

DETAILED DESCRIPTION OF THE INVENTION

Figure 1:
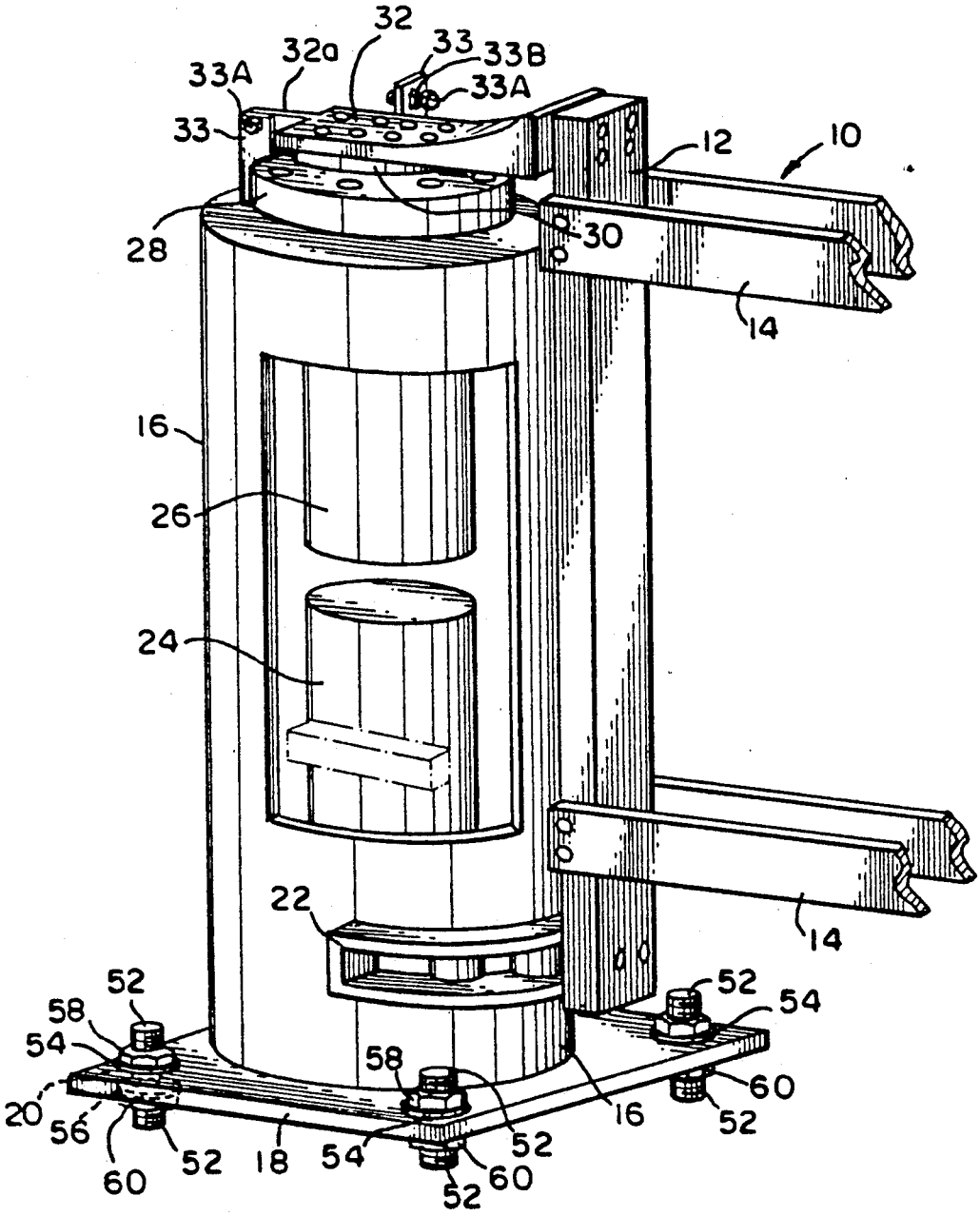
FIG. 1 is a rear view of the operating mechanism mounted within the gate-post with a portion thereof broken away to illustrate the relative positions of the power unit at the lower portion of the post and the cooperating actuator situated above the power unit, but connected therewith, the actuator being adapted to provide rotary means at the top of the gate for opening or closing the same.

Referring now more particularly to FIG. 1, which exemplifies a preferred gate support and operating mechanism constructed and arranged according to the present invention, there is shown a gate or gate means 10 having an upright 12 to which top and bottom cross pieces 14 are fastened by bolts or otherwise. The gate member 10 may be of a type which opens inwardly or outwardly and, for that purpose, is pivotally connected to a gate-post 16 positioned adjacent the upright 12. The post 16, in turn, is fixed against movement by being secured to a base 18 as by corner bolts 20 cemented into a concrete foundation (not shown) underlying the base 18.

It will be understood, of course, that the gate 10 may, as desired, comprise a single, automated gate door system, or in the alternative, a double door system. It will also be understood by the skilled artisan that the gate could be vertically raised, as discussed more fully hereinafter, or moved in a linear or longitudinal manner to open and close, in addition to the rotary opening illustrated in FIG. 1. Solid teak wood is a preferred construction material for the gate and gate-column. All visible hardware may be made of stainless steel or anodized aluminum; and the column caps may be of copper composition. Optionally, the columns may be made of marble or granite. Signs, logos and inscriptions in wood, stone or bronze may also be included on the gate proper or the gate column.

Encircling the lower portion of the post 16, an open faced annular-shaped ring or band-like collar 22 traverses the outer periphery of the post 16 and is adapted to be rotated around post 16 in unison with the lower end of the gate upright 12 to enable the gate 10 to open or close as upright 12 is rotated in either direction.

Means are provided at the top of the post 16 for moving the upper and lower portions of the upright 12 about its pivot point. Simultaneously, the collar 22 is moved around the outer periphery of post 16 and the gate 10, including its cross members 14 and an upright support 12, opens or closes correspondingly.

In the case of the double door system according to the present invention, the rotating collar 22 and upright 12 construction and operation are duplicated on the other side of the gate.

Inside the stationary post 16, which may be hollowed for this purpose, there is provided a power unit 24 which supplies hyraulic power to a pivot or rotary actuator 26 with which it is connected to function. The actuator 26 terminates in a relatively large flange or drive means 28 by means of which it may be conveniently mounted on the top of the post 16.

Figure 15:
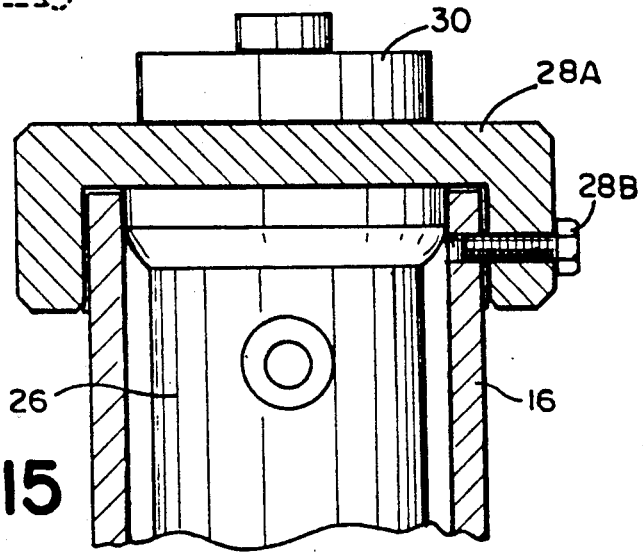
FIG. 15 is an elevation of a gate actuator mounted on the gate post, shown in section; by a flange, shown in section.

FIG. 15 shows an alternative embodiment of this mounting in which the flange 28A overhangs and wraps around the outside of gate post 16. Actuator 26 is thereby secured to post 16 by bolts 28B which are screwed the sidewall of flange 28A.

A shaft 30 (see FIG. 2) projecting from the upper end of the vertically mounted actuator 26 is rotatable thereby; and fixed to the shaft 30 is a cover or coupling plate 32 (FIG. 1). Plate 32 is also fastened to the end of the upright 12 of gate 10: the arrangement being such that as shaft 30 of the actuator 26 is rotated, the plate member 32 is correspondingly and simultaneously moved in the horizontal plane so that plate member 32 serves as a drive arm for the gate; and the gate 10 moves with the plate 32 and shaft 30 in the same direction and to the same extent.

Means for restricting or limiting the extent of the opening or closing of the gate 10 may conveniently comprise a solid metal projection 32*a* adapted to bear against either of the spaced adjustable stops 33 incorporating threaded bolts 33A and lock-nuts 33B attached to the upper surface of column member 16. As such, the metal projection 32*a* functions as a stop bar.

Because the extent of rotation of the cover plate 32 and corresponding door opening and closure are limited by the stops 33, it is not necessary that the lower collar 22 completely encircle or surround the outer periphery of the post 16. On the contrary, it is sufficient if that collar 22 forms merely an arc instead of a complete circle around post 16. As such, the collar 22 serves as an arc-shaped follower for journalling the bottom portion of the gate post within roller bearings contained with the arc-shaped collar, as specifically shown in FIG. 1.

Proximity switches or conventional limit switches of the type disclosed in U.S. Pat. No. 3,785,089 may be conveniently located so as to de-energize the actuator 26 when the gate 10 is in the open or closed positions. Similarly, a remote control unit such as a conventional radio controlled-type positioned at a place inside or outside the area enclosed by the gate 10 may be utilized to effect opening and closing of the gate from a distant location. Moreover, a manually operable valve or lever may be applied to open and close the gate from a position adjacent the gate 10 itself.

Figure 2:
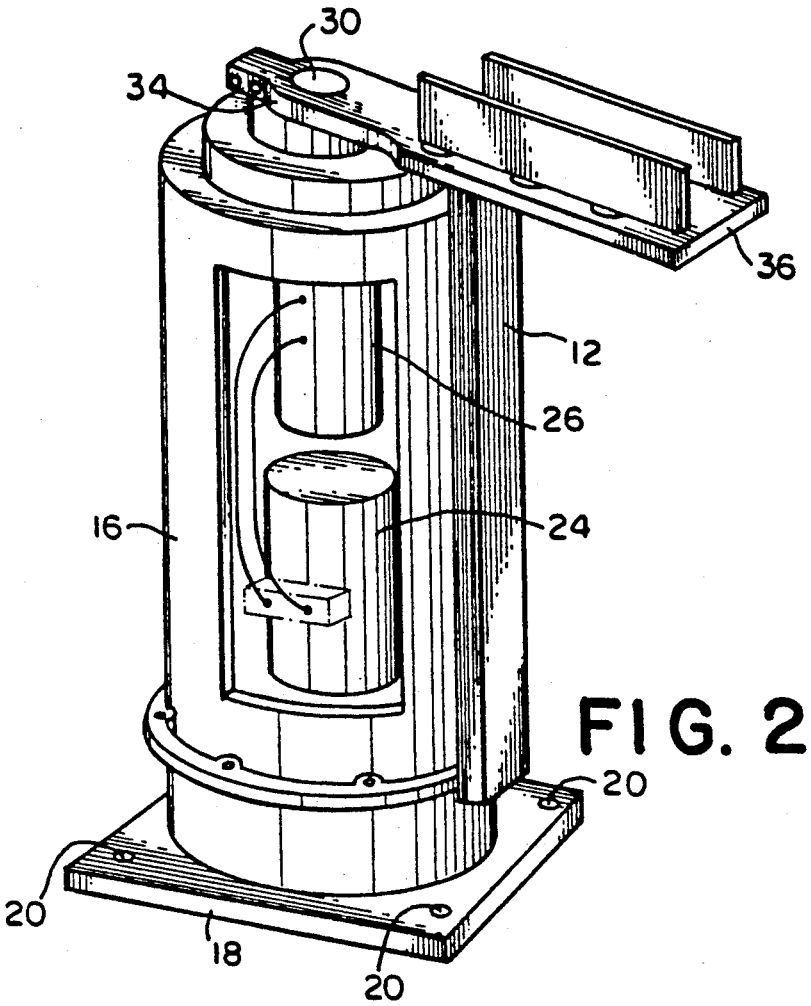
FIG. 2 is a rear view similar to that of FIG. 1, but including connecting wires between the power line on the bottom and actuator thereabove, together with an alternate arrangement for connecting the gate to a rotatable shaft at the top of the rotary actuator.

FIG. 2 illustrates an alternative means for connecting the rotatable shaft member 30 of actuator 26 to the gate 10 and the upright 12. That is to say, a bifurcated clamp 34 replaces the plate 32 and comprises a generally rectangularly shaped metal projection 36 adapted to support the upper end of the relatively heavy gate 10 thereby preventing such gate from sagging under its own weight. This, of course, will be understood as an important consideration with respect to the operation and opening and closing of heavy gates of that character.

Figure 3:
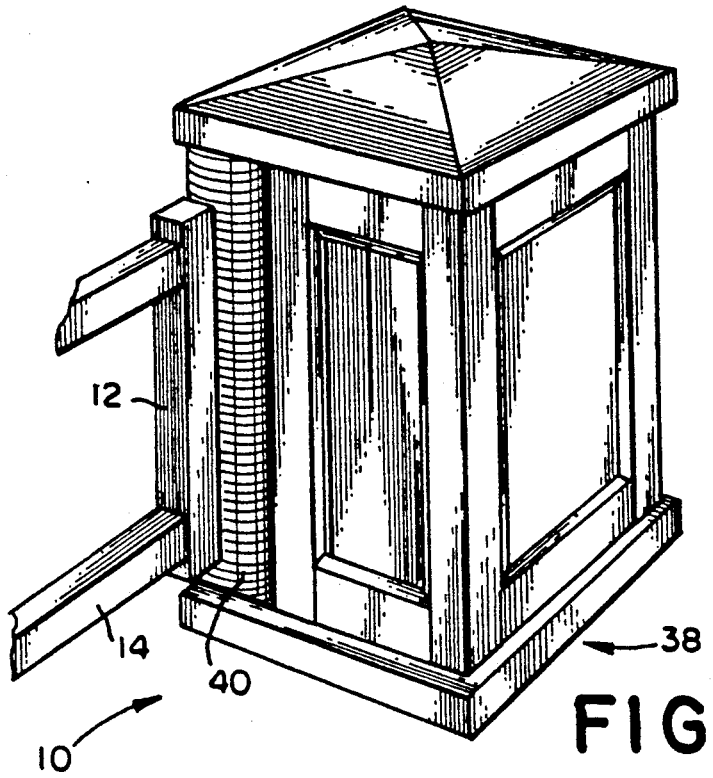
FIG. 3 is a perspective view of the gate-column within which the operating mechanism may be concealed and includes a stainless steel cover around the rotary portion of the mechanism forwardly of the gate entrance.

In FIG. 3, the operating mechanism of the inventive assembly is concealed from view by means of a relatively large overall four-sided housing 38 and includes, in one corner section thereof, for example, a stainless steel or copper cover 40 around the mechanism proper.

Figure 4:
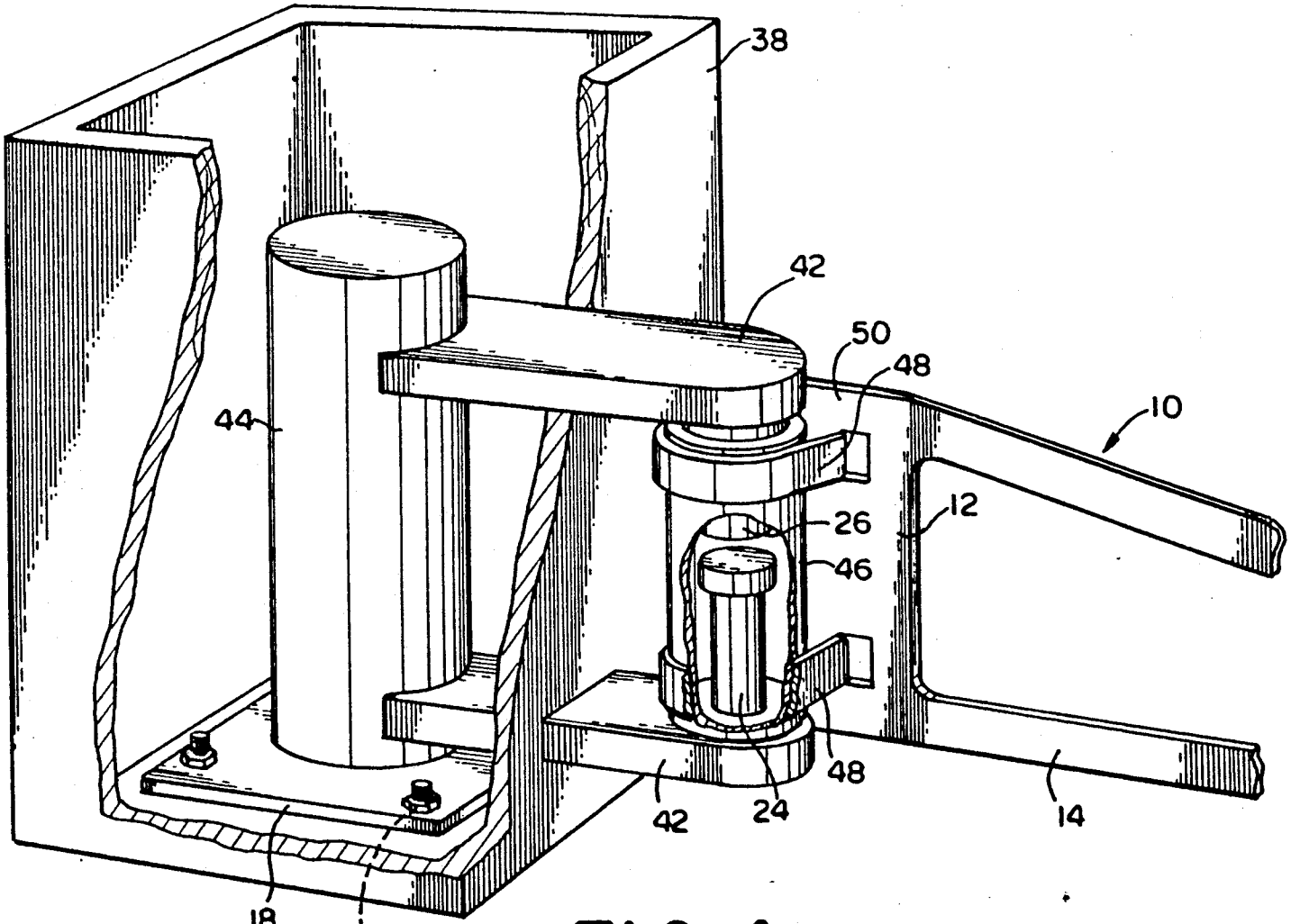
FIG. 4 illustrates that embodiment of the invention which places the operating mechanism outside the gate column or post and securely fastens it, as by means of steel straps to hinge proper adjacent the gate-column.

In FIG. 4, there is seen a modified form of the inventive gate closure and opening assembly, wherein the operating mechanism is mounted outside of the post housing, and secured to the gate hinge which connects the gate 10 to the housing. In this embodiment, the gate-column housing 38 is provided with spaced upper and lower apertures to constitute openings for a pair of spaced arms 42 which extend laterally and in spaced relationship with respect to each other from a solid fixed post 44: such post 44 being securely fastened to the base member 18. The gate operating mechanism comprising the power unit 24 and coacting actuator 26 are concealed within a relatively small metal container 46 to which gate hinge 50 is securely mounted as by the steel straps 48 on the gate hinge 50.

Figure 5:
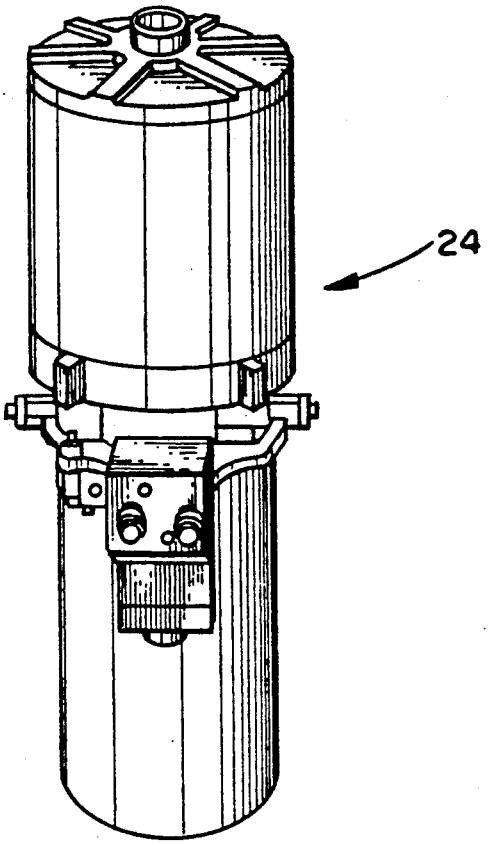
FIG. 5 shows the vertically disposed reversible power unit which coacts with the actuator, thereby supplying the power for opening or closing the gate.

The power unit 24 is represented in FIG. 5 and may consist of a power unit such as that referred to as a "330 series reversible locking power unit" and described in a brochure identified as Form No. 723 of Oildyne, Inc. of Minneapolis, Minn. 55428.

Figure 6:
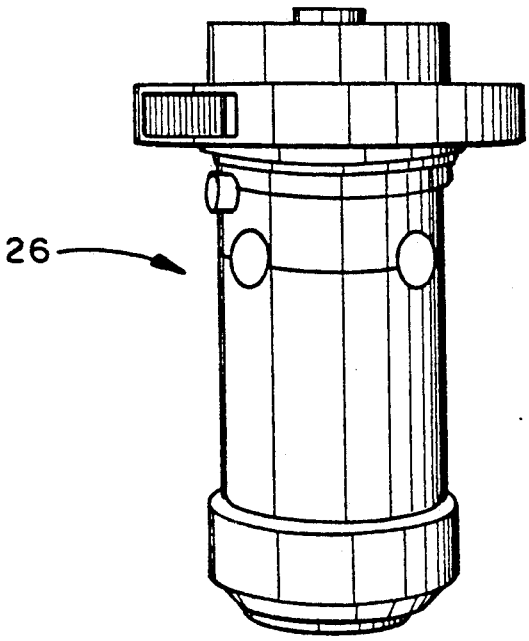
FIG. 6 is a front view of the flange mounted pivot actuator.

Similarly, the actuator 26 presented in FIG. 6 may consist of a so-called "Helac flange mounted pivot actuator" identified and described under the designation Model 10K in a brochure of the Helac Corporation of Enumaclaw, Wash. 98022, entitled "Helac Rotary Actuators" CP 32693, Copyright 1982.

The present inventive gate systems may also include added features as desired, such as illumination on the gate structure, telephone communication and access, pre-programmed micro-computer system controller, safety controls, sub-service concrete footings, and above-ground granite pads or bases.

As specified in the Summary of the Invention, if the circumstances of the particular installation make it desirable, the relative position of the gate-post with respect to the stationary base to which it is to be affixed may be adjusted during initial installation or subsequently by bodily elevating the gate-post or tilting it as as to facilitate satisfactory installation and subsequent operation of the gate closure. To that end, as exemplified in FIG. 1, the present inventive assembly may comprise threaded rods 52 extending above and below the four corner portions of the base plate 18 and through the four bolt holes 20. Washers 54 and 56 are placed over the projecting upper and lower portions of the rods 52 so as to make contact with the adjusting fastener nuts 58 and 60, respectively.

By altering, that is, by selectively screwing or unscrewing the coacting fasteners 58 and 60 so as to alter their relative position lengthwise of the threaded rods 52, the gate-post 60 may be correspondingly raised, lowered or tilted.

As will be understood, if it is desired to provide the present assembly without means for adjusting the relative position of the gate-post, then it may be fixed to the bottom plate 18 as by conventional bolts inserted in the bolt holes 20 in FIG. 1. On the other hand, where the inventive adjusting means are to be provided in the assembly for raising, lowering or tilting the relative position of the gate-post member 16, then the threaded rods 52 are run through the holes 20 in the bottom plate 18 in place of the ordinary bolts. For convenience of illustration only, FIG. 1 is shown with the adjusting means comprising the threaded rods 52 at the four corners of the base plate 18 instead of four bolts.

VERTICALLY ROTATING EMBODIMENT

Figure 7:
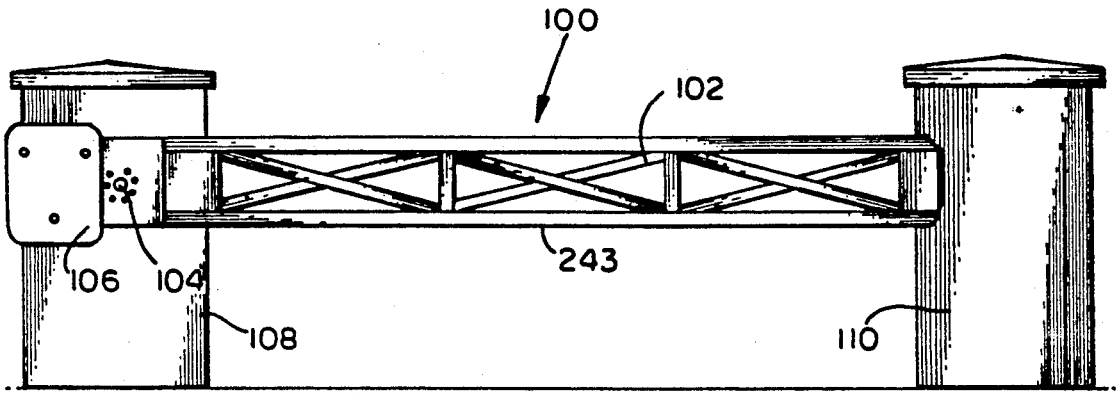
FIG. 7 is a front elevation of the vertically swinging embodiment.

FIG. 7 shows a front view of a vertically rotating 76 embodiment of the gate, generally designated 100. The opening of the gate is barred by beam means such as beam 102 which is mounted to rotate in a vertical plane about shaft 104. Counterweight 106 is mounted on the far side of shaft 104 from beam 102. Housing means, such as gate-column 108 houses the actuator mechanism which rotates the beam. At the side of the opening opposite actuator gate-column 108 is a second gate-column 110 which may house a control station.

Figure 8:
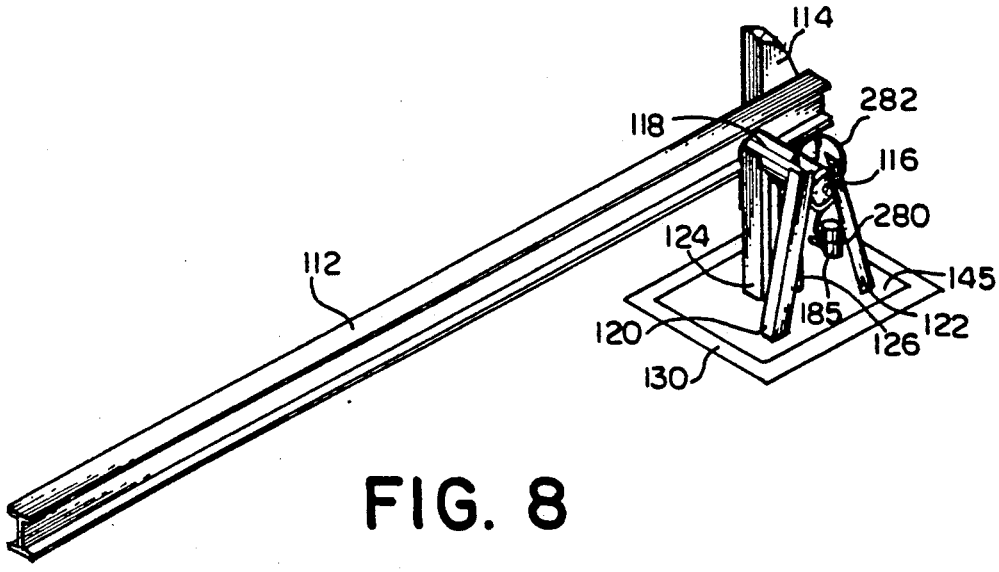
FIG. 8 is an oblique view of the same invention showing the actuator and its mounting.
Figure 9:
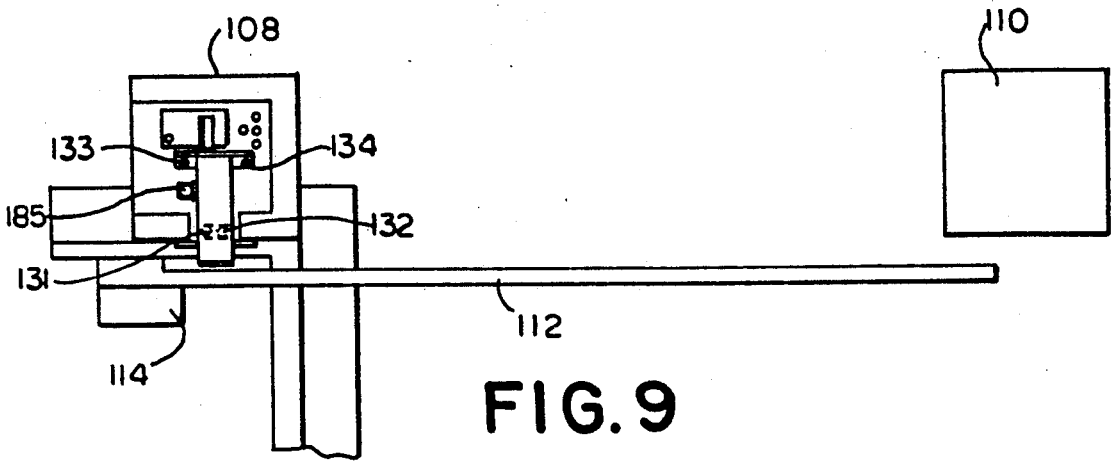
FIG. 9 is a plan view of the gate shown in FIG. 7 including both gate-columns.
Figure 10:
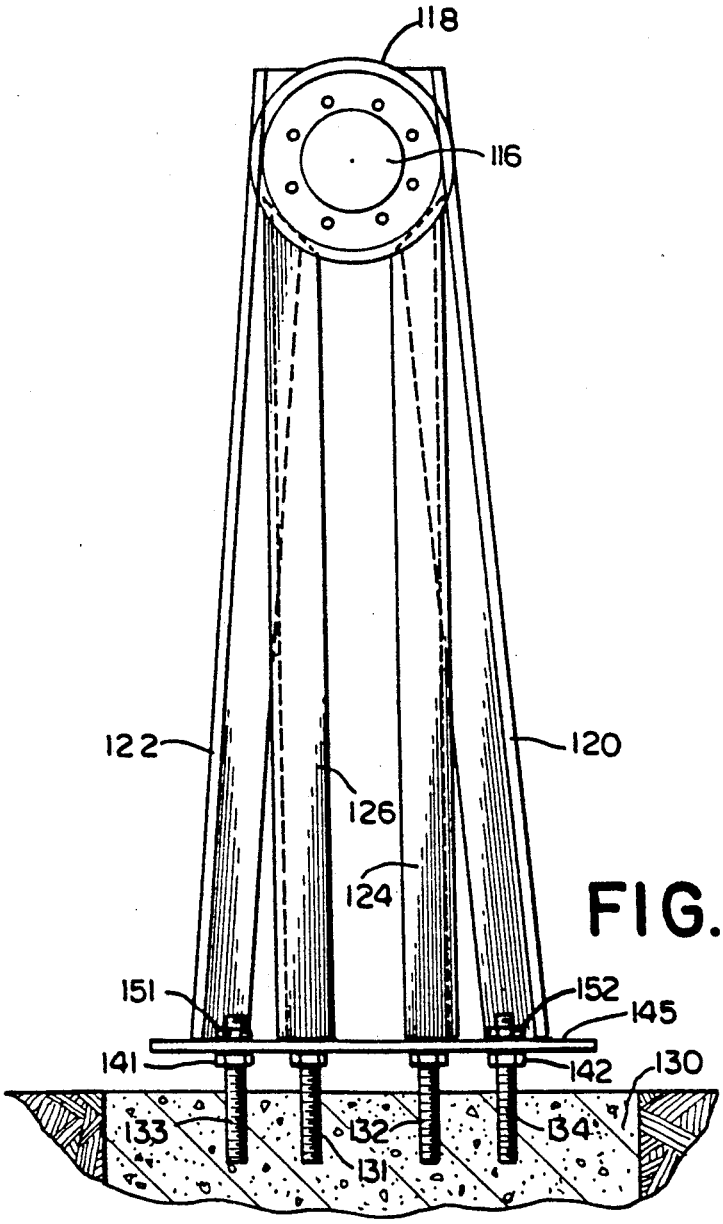
FIG. 10 is a front elevation of the actuator housing and the mounting shown in FIG. 8.

FIG. 8 shows an embodiment having a more rudimentary gate or beam means such as beam 112, including counterweight 114. Hydraulic actuator 116, which is the same as described above in previous embodiments, is mounted horizontally in housing 118. Actuator housing 118 is welded to four support legs including back legs 120, 122 and front legs 124, 126. These legs are mounted atop footing 130 by means of bolts comprising threaded rods 131–134 shown in FIGS. 9, 10 and 11 which are mounted in concrete footing 130 as shown in FIG. 10. Height and attitude adjustment nuts such as 141, 142 are threaded onto these rods, such as 131, 132, and base 145 of legs 120, 122, 124 and 126 is rested upon the mounting nuts. The base is then secured by securement nuts, such as 151, 152, which thread onto rods 131, 132.

Figure 11:
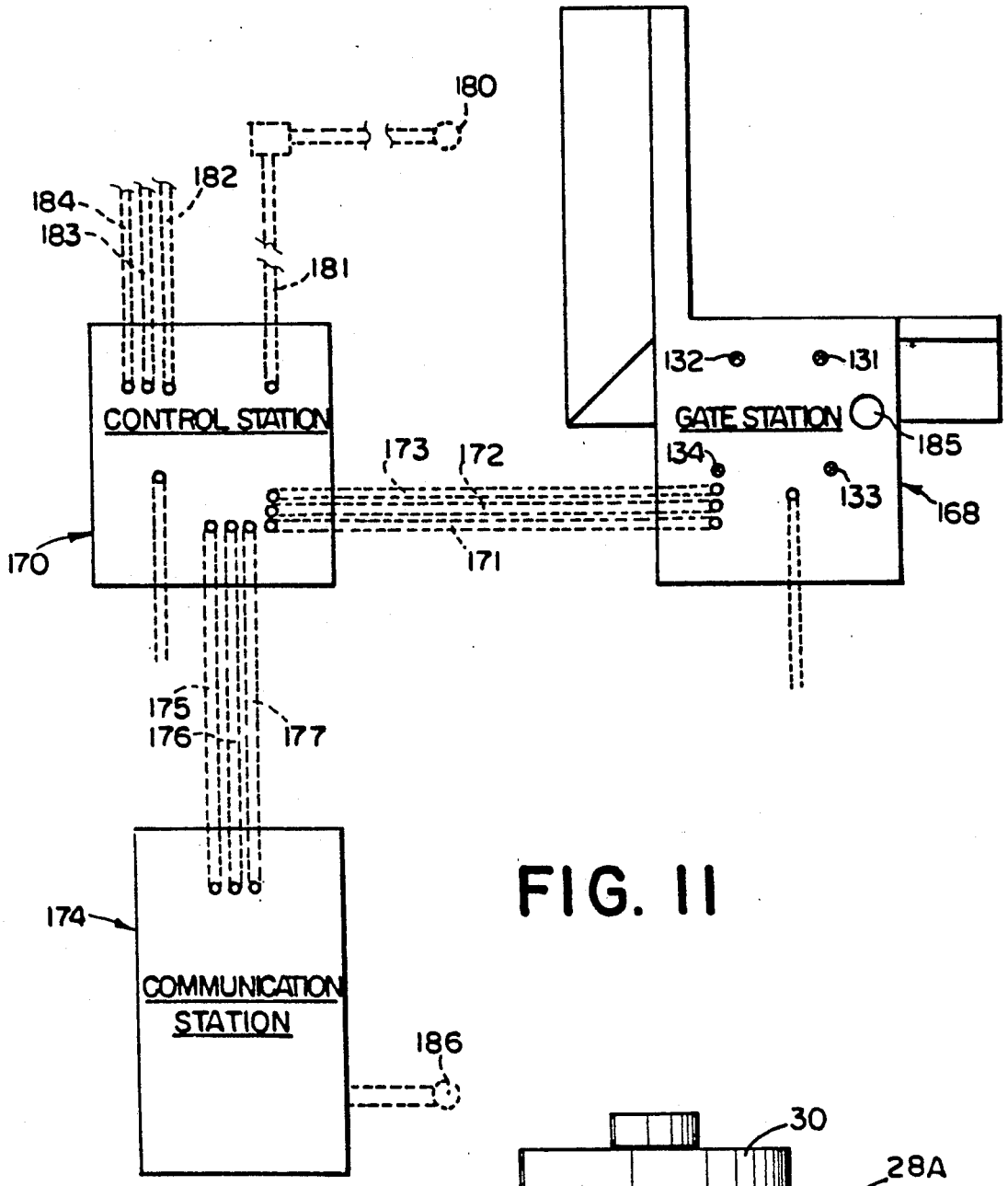
FIG. 11 is a plan view in the nature of a block diagram showing various elements of the system.

FIG. 11 shows a somewhat compressed plan view of the elements of the gate. Gate station 168 serves as the mounting pad and contains the actuator which comprises the hinge-post for the beam and counterweight. This pad communicates by 24 volt conduit 171 and 110 volt conduits 172,173 with control station 170. The 24 volt conduit 171 supplies 24 volt power in either of two polarities depending upon whether the gate is to be rotated open or closed. Control station 170 communicates with a communication station 174 by means of conduits 175, 176, 177. In practice, a car would arrive at communications station 174 and call through control station 170 over an intercom or phone line 182 to the building to which the gate is controlling access. A control signal is passed through this intercom line to control station 170, which supplies 24 volt power to the hydraulic pump 185, which pumps hydraulic fluid through the actuator in a direction which rotates the beam upward and clear of the opening. When a vehicle passes over driveway sensor 180, the driveway sensor causes a signal to the control station. The control station then reverses the polarity on the 24 volt power line which causes pump 185 to pump hydraulic fluid in the opposite direction. That pump then supplies fluid to the actuator in a direction which rotates the gate closed.

A car coming from within the enclosure will be sensed by driveway sensor 180 which is located about 150 feet from the gate. The control station will then cause the gate to open automatically. A second sensor 186 at communication station 174 can signal the control station to close the gate.

Figure 12:
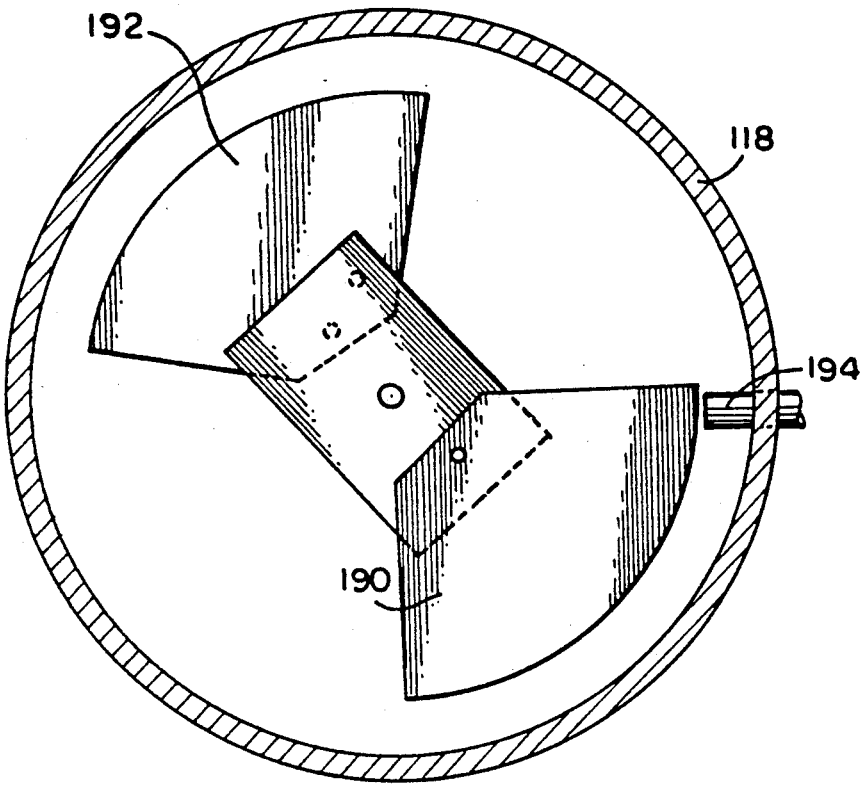
FIG. 12 is a rear elevation of a cam-and-switch gate position sensing means.
Figure 13:
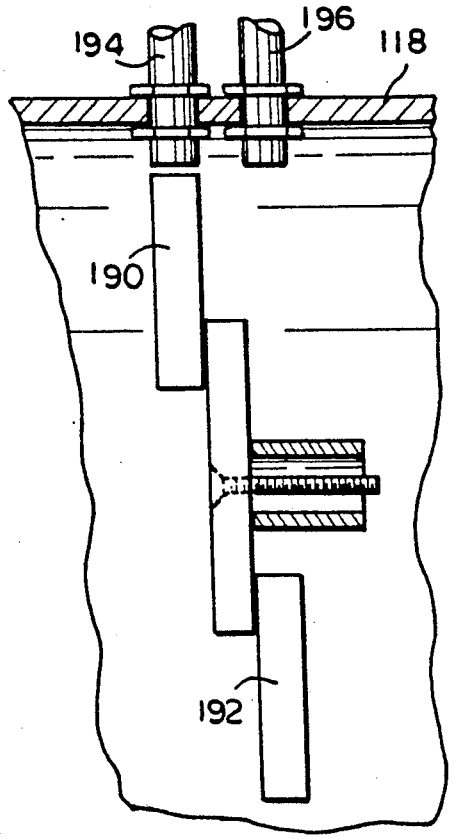
FIG. 13 a plan view thereof.

FIGS. 12 and 13 show a cam and switch assembly used to achieve proper orientation of the gate. Cam 190 is shown in FIG. 12 and in FIG. 13 adjacent to the switch 194. Cam 190 is made of a magnetic material and switch 194 is magnetically actuated so that when cam 190 is in the position shown, it signals the controller that the gate is in its vertical and open position and the controller should not cause the actuator to drive the gate any further in that direction. Conversely, when the controller supplies power to the pump causing the actuator to close, cam 192 eventually comes into a position where it is sensed by magnetic switch 196. Switch 196 signals the controller, which is programmed to terminate power to the pump, thereby halting the action of the actuator and the movement of the beam.

Figure 14:
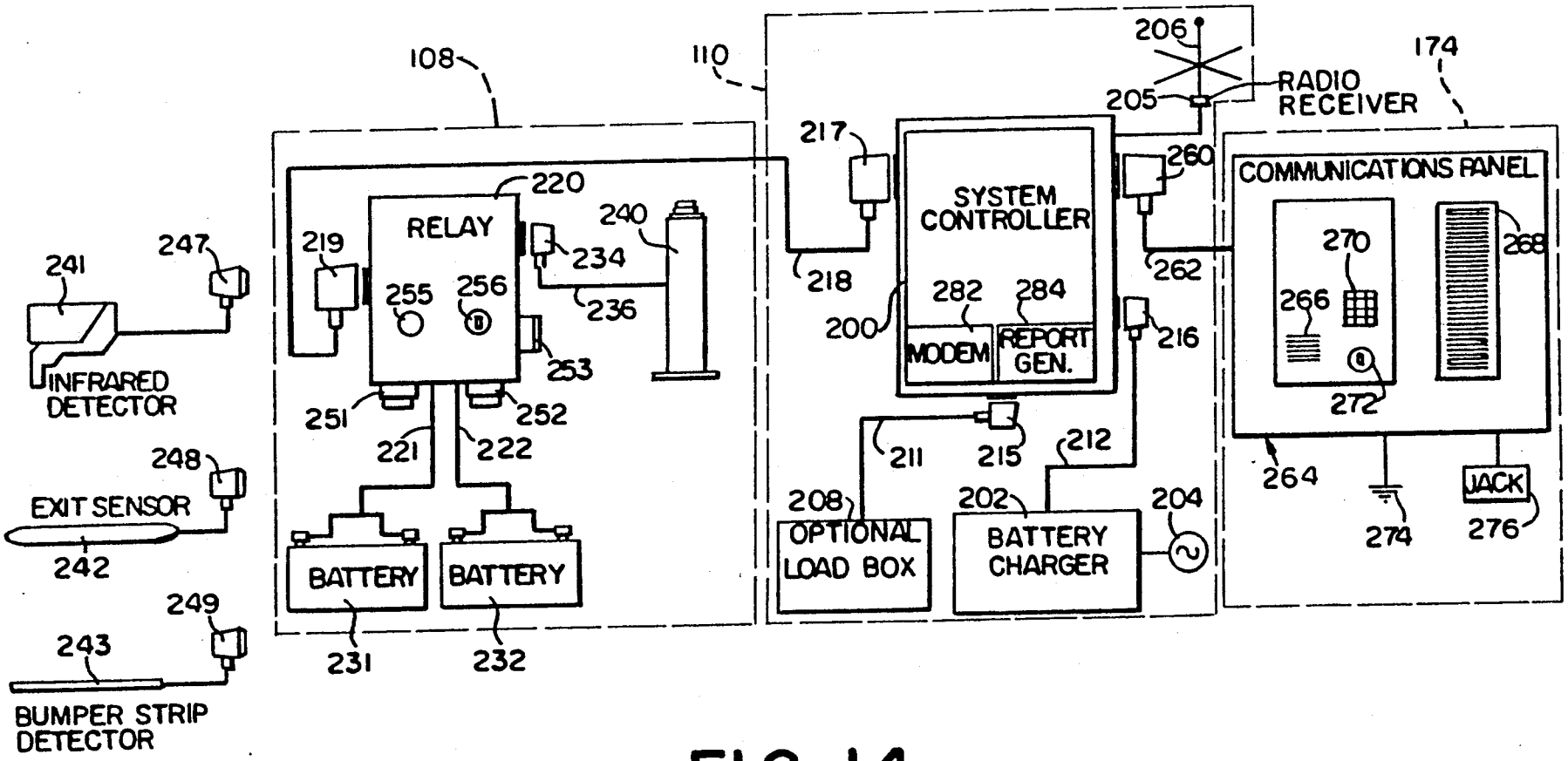
FIG. 14 is a block diagram of the gate system.

FIG. 14 is a block diagram showing the electrical layout of the gate system. Dotted lines 108, 110, 174 divide the parts of the system into the boxes in which they are enclosed. Box 108 is the actuator gate-column. Box 110 is the control station gate-column and box 174 is the communication station. The heart of the system is the system controller 200. System controller 200 receives 24 volt power from battery charger 202 which is in turn powered by a 110 volt AC source such as 110 volt socket 204, located within the gate-column. System controller 200 may also include a radio receiver 205 which may communicate by means of antenna 206 with a transmitter located within authorized vehicles. System controller 200 may also be connected to optional load box 208. Electrical cables 211, 212 and electrical connectors 215, 216 connect the battery charger and load box to the system controller. Connector 216 is color coded green and connector 215 orange. These colors correspond with colors on the connector sockets of the system controller in order to facilitate installation. Black connector 217 connects the system controller through cable 218 and connector 219 to relay box 220.

12 volt cables 221, 222 connect the relay box to two deep-discharge type 12 volt storage batteries 231, 232 and supply a trickle charge of 24 volts to batteries 231, 232 which are connected in series. The batteries in turn supply power at a greater rate under the demand of powering the gate actuator pump. Red connector 234 transmits the battery power. The two 12 volt batteries 231,232 are connected in series in order to supply 24 volts through connector 234 and cable 236 to gate operator 240. Sensors may be used in any combination. Infrared detector 241, exit sensor 242 or bumper strip 243 may be set up to communicate via yellow connectors 247, 248, 249 through yellow sockets 251, 252, 253 with the relay box.

Infrared detector 241 may be used to beam across the opening and detect the presence of a car therein. Exit sensor 242 is an inductive sensing coil located under the roadway. Bumper strip 243 will be placed upon the edge of the beam 102 (FIG. 7) so that, if the beam strikes anything, the bumper strip will transmit a signal which can be used to stop the gate from further motion.

System controller 200 (FIG. 14) is also connected by means of blue connector 260 and cable 262 to communications panel 264 located within communications station 174. Communications panel 264 comprises a microphone 266 and a speaker 268 by means of which a person at the gate may communicate with a person at a control location. Key pad 270 enables the person at the gate to call the gate owner over telephone lines, either by dialing that person's number or by dialing a speed-dialing code. The key pad may also be used to key in a coded control number to open the gate. Key switch 272 enables the gate to be actuated by key control means. As is required with telephone communication, a ground pole 274 is provided in order to ground communications panel 264. A telephone jack, such as a standard RJ11C jack 276 is provided. A telephone of communications panel 264 is connected to the telephone system via jack 276.

In addition to using the telephone lines to communicate with the gate owner, whatever his location, the telephone lines and communications panel may be used by the gate manufacturer in order to service the gate system. The manufacturer may telephone the communications panel and interrogate the system controller as to the status of various components of the gate. This tele-diagnostic procedure can be used to verify proper functioning of the gate or to pinpoint faults in the gate system. Such pinpointing can facilitate the servicing of the gate by a repairman and, in some cases, certain faults may be corrected by commands transmitted from the manufacturer over the telephone lines.

In order to facilitate service, communications panel 264 is equipped with speed dialing so that dialing of "99" on key pad 270 will dial the number of the manufacturer's service personnel. The gate system contains a tele-diagnostic package which includes a modem 282 and a report generator 284.

System controller 200 contains an electrically alterable programmable read-only memory. This memory may be programmed remotely by the manufacturer to the customer's exact operating specifications, including to personal preferences such as gate opening and closing frequency, length of time the gate should remain open, driveway lighting timing, and lawn sprinkler system timing.

The standard gate setting is two minutes per opening, which means that when the gate is activated it will remain open for two minutes or until a car passes through and is detected by the infrared beam, whichever occurs first. In addition, the following also applies:

If a car is detected, the gate closes no later than ten seconds after that detection.

If another car is detected, the ten second count begins again.

If a second "open" command is issued—for example, if the gate opening device is used again—the two minutes begins again.

As a safety feature, relay box 220 contains a kill switch 255 which instantly disables the system for service situations. Once kill switch 255 is hit, the system can only be reset using key switch 272 at communications station 174.

Controller 200 is also programmed to expect a normal gate actuator run time of eight to ten seconds. If the motor at the operator station continues to run for one minute, an emergency is assumed and the system will go into standby mode. The system can only be reset using key switch 272 at communications station 174.

An infrared beam is preferably installed to shine between two gate-columns 108–110 (FIG. 7) If the beam is broken, the system stops immediately. If the beam is then re-established, the computer begins a ten second count before restarting the gate. If the beam is broken and reunited a second time, the computer begins the ten second count again. The beam also senses traffic flow and initiates a close after ten seconds.

On the gate operator 240, shown in FIG. 8 as pump 185 and actuator 116, is manual override valve 280 attached to hydraulic plumbing 282 in case of motor failure. Valve 280, when open, will allow easy pushing of gate beam 112 to an open or closed position by hand. The gate will not operate by motor unless override valve 280 is in its normal position—closed.

Manual motor operation may be accomplished by inserting a key in key switch 256 (FIG. 14) on relay box 220 at the operator station 108.

What is claimed is:

1. An assembly for supporting and operating a gate comprising:

(a) a generally hollow tubular-shaped gate post disposed in a generally upright position with a top end;

(b) a hydraulic power source;

(c) a hydraulically-powered rotary actuator housed within the gate post, said rotary actuator including a rotatable drive shaft having one end which protrudes externally from the top end of the gate post, said hydraulic power source supplying hydraulic power to the rotary actuator to rotate the drive shaft in order to enable movement of the gate between open and closed positions;

(d) an upright support for the gate having an upper end and a lower end;

(e) a drive arm transversely mounted relative to the drive shaft, the drive arm having a first end affixed to the end of the drive shaft which protrudes from the top end of the gate post and having a second end affixed at the upper end of the upright support for supporting the gate relative to the drive shaft to enable the drive shaft to rotatably move the gate between the open and closed positions; and (f) an arc-shaped follower affixed generally at the lower end of the upright support in position for journalling a bottom portion of the gate post in order to support the gate in position to enable the drive arm to rotatably move the upright support, the follower, and the gate around the gate post.

2. The assembly in accordance with claim 1 wherein the drive shaft extends from said rotary actuator and the end of the drive shaft which protrudes externally from the top end of the gate post includes an end surface and wherein the first end of the drive arm is affixed generally onto said end surface so that rotation of the drive shaft causes corresponding simultaneous rotation of the gate.

3. The assembly in accordance with claim 1 wherein the arc-shaped follower includes roller bearings for journalling the bottom portion of the gate post.

4. The assembly in accordance with claim 1 wherein the gate post is affixed onto a stationary base and wherein adjustment means are provided on the stationary base for permitting the relative upright position of the gate post to be adjusted.

5. The assembly in accordance with claim 1 including a pair of spaced apart stops at the top end of the gate post and a stop bar on the first end of the drive arm positioned for movement between the pair of stops when the drive shaft rotates to move the gate between the open and closed positions, the stops being positioned to respectively engage the stop bar in order to respectively limit the rotatable movement of the gate at the open and closed positions.

6. The assembly in accordance with claim 1, 2, 3, 4 or 5 wherein the hydraulic power source is housed within the gate post and wherein the rotary actuator is mounted above the hydraulic power source within the gate post.

7. An assembly for supporting and operating a gate comprising:

(a) a generally hollow gate post oriented in a generally upright position;

(b) a hydraulic power source;

(c) a hydraulically-powered rotary actuator housed within the gate post, said rotary actuator including a rotatable drive shaft having one end which protrudes externally of the gate post, said hydraulic power source supplying hydraulic power to the rotary actuator to rotate the drive shaft in order to enable movement of the gate between open and closed positions;

(d) an upright support for the gate having an upper end and a lower end;

(e) a drive member affixed generally at the end of the drive shaft which protrudes from the gate post and generally to the upper end of the upright support for the gate for supporting the gate relative to the drive shaft to enable the drive shaft to rotatably move the gate between the open and closed positions; and (f) an arc-shaped follower affixed generally at the lower end of the upright support in position for journalling a bottom portion of the gate post in order to support the gate in position to enable the drive member to rotatably move the upright support, the follower, and the gate around the gate post.

8. The assembly in accordance with claim 7 wherein the end of the shaft which protrudes externally of the gate post includes an end surface oriented generally transverse to the drive shaft, and wherein the drive member is affixed onto said end surface.

9. The assembly in accordance with claim 7 wherein the arc-shaped follower includes roller bearings for journalling the bottom portion of the gate post.

10. The assembly in accordance with claim 7 wherein the gate post is affixed onto a stationary base in a generally upright position and wherein adjustment means are provided on the stationary base for permitting the relative upright position of the gate post to be adjusted.

11. The assembly in accordance with claim 7 including a pair of spaced apart stops on the gate post and a stop bar on the drive member positioned for movement between the pair of stops when the drive shaft rotates to move the gate between the open and closed positions, the stops being positioned to respectively engage the stop bar in order to respectively limit the movement of the gate at the open and closed positions.

12. The assembly in accordance with claim 7 wherein the hydraulic power source is housed with the gate post.

* * * * *